US010363596B2

(12) United States Patent
White

(10) Patent No.: US 10,363,596 B2
(45) Date of Patent: Jul. 30, 2019

(54) THREE-DIMENSIONAL WIRE BENDING JIG

(71) Applicant: Wyatt White, Coatesville, PA (US)

(72) Inventor: Wyatt White, Coatesville, PA (US)

(73) Assignee: Wire and Cable Specialties, Inc., Coatesville, PA (US)

( * ) Notice: Subject to any disclaimer, the term of this patent is extended or adjusted under 35 U.S.C. 154(b) by 323 days.

(21) Appl. No.: 14/922,337

(22) Filed: Oct. 26, 2015

(65) Prior Publication Data

US 2016/0136719 A1 May 19, 2016

Related U.S. Application Data

(60) Provisional application No. 62/079,614, filed on Nov. 14, 2014.

(51) Int. Cl.
*B21F 1/00* (2006.01)
*B21F 43/00* (2006.01)
*D02G 3/00* (2006.01)

(52) U.S. Cl.
CPC ..... *B21F 1/002* (2013.01); *B21F 43/00* (2013.01); *D02G 3/00* (2013.01)

(58) Field of Classification Search
CPC ..... B21F 1/002; B21F 43/00; B21F 45/00; D02G 3/00; D04B 5/00; D04B 3/00; D04B 39/00; A44C 27/001; D04D 1/02; A47F 5/02–05; F16M 11/00
See application file for complete search history.

(56) References Cited

U.S. PATENT DOCUMENTS

| | | | | | |
|---|---|---|---|---|---|
| 2,649,130 | A * | 8/1953 | Border | B21F 3/04 | 29/618 |
| 3,194,279 | A | 7/1965 | Brown | | |
| 3,653,411 | A | 4/1972 | Mosher et al. | | |
| 4,483,373 | A | 11/1984 | Tarbox | | |
| 4,775,349 | A * | 10/1988 | Short | A63H 33/12 | 446/107 |
| 5,878,788 | A * | 3/1999 | Gurry | B21F 1/002 | 140/71 R |
| 6,253,798 | B1 | 7/2001 | Helwig | | |
| 8,047,478 | B1 * | 11/2011 | Krauss | A63B 9/00 | 211/182 |
| 8,696,260 | B2 * | 4/2014 | Oettle | B23B 27/1614 | 407/103 |
| 2009/0127215 | A1 * | 5/2009 | Gale | A47B 61/04 | 211/85.3 |
| 2011/0265908 | A1 * | 11/2011 | Clerc | A61F 2/90 | 140/71 R |
| 2012/0073697 | A1 * | 3/2012 | Eddy | D04B 5/00 | 140/123 |

* cited by examiner

*Primary Examiner* — Pradeep C Battula
(74) *Attorney, Agent, or Firm* — Joseph E. Maenner; Petock & Petock, LLC

(57) ABSTRACT

A three-dimensional wire bending jig is disclosed. The jig includes a tubular body having an outer diameter and an inner diameter. The body has a plurality of through-openings formed therein. The plurality of through-openings form a repeating pattern around the body. A kit including the jig, a plurality of pins, and a retaining member is also provided.

10 Claims, 4 Drawing Sheets

THREE-DIMENSIONAL WIRE BENDING JIG

CROSS-REFERENCE TO RELATED APPLICATION

The present application claims priority from U.S. Provisional Patent Application Ser. No. 62/079,614, filed on Nov. 14, 2014, which is incorporated by reference herein in its entirety.

FIELD OF THE INVENTION

The present invention relates to jigs, and more specifically, to jigs for bending jewelry wire in specific patterns in three-dimensional shapes.

BACKGROUND OF THE INVENTION

Existing jewelry wire bending jigs are two-dimensional, meaning, that while they have a length and a width, allowing for the formation of two-dimensional wire jewelry, they do not provide a third dimension, such as, for example height, sufficient to allow for the formation of three-dimensional jewelry.

There exists a need to provide a three-dimensional jewelry wire bending jig that allows the formation of in the traditional two-dimensional plane, along with a third, height dimension, extending perpendicular to the two-dimensional plane.

BRIEF SUMMARY OF THE PRESENT INVENTION

Briefly, the present invention provides a three-dimensional wire bending jig. The jig includes a tubular body having an outer diameter and an inner diameter. The body has a plurality of through-openings formed therein. The plurality of through-openings forms a repeating pattern around the body.

The present invention also provides a kit including the jig, a plurality of pins, and a retaining member.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION OF THE INVENTION

Figure 1:
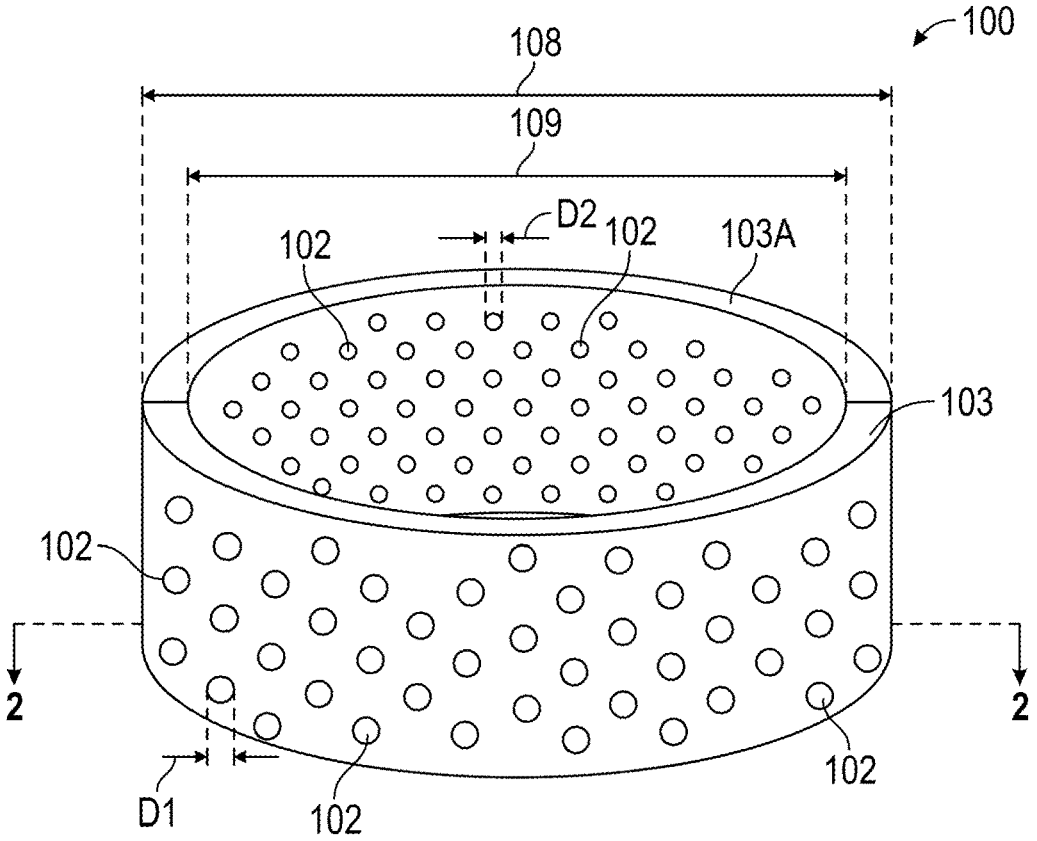
FIG. 1 shows a perspective view of a three-dimensional wire bending jig according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Referring to FIGS. 1-4, a three-dimensional wire bending jig 100 ("jig 100") according to a first exemplary embodiment of the present invention is shown. Jig 100 is used as a template to bend wire, such as, for example, to form loops or bends, creating a circular bangle or bracelet shape made from the bent wire.

As shown in FIG. 1, jig 100 can be a circular cylinder or tubular body having a plurality of through-openings 102 formed therein. Alternatively, although not shown, jig 100 can be other shapes besides, circular, including, for example, but not limited to, oval, square, rectangular, or other suitable shapes.

The three-dimensional configuration of jig 100 allows for the formation of three-dimensional bent wire shapes, such as, for example, bracelets having a perimeter extending along a plane, as well as an extended length extending perpendicular to that plane.

In an exemplary embodiment, jig 100 can be formed from two separate semi-circular pieces 103, 103A that are joined together. In an exemplary embodiment, pieces 103,103A can be separately injection molded and then joined together, forming a 360° circle.

Figure 2:
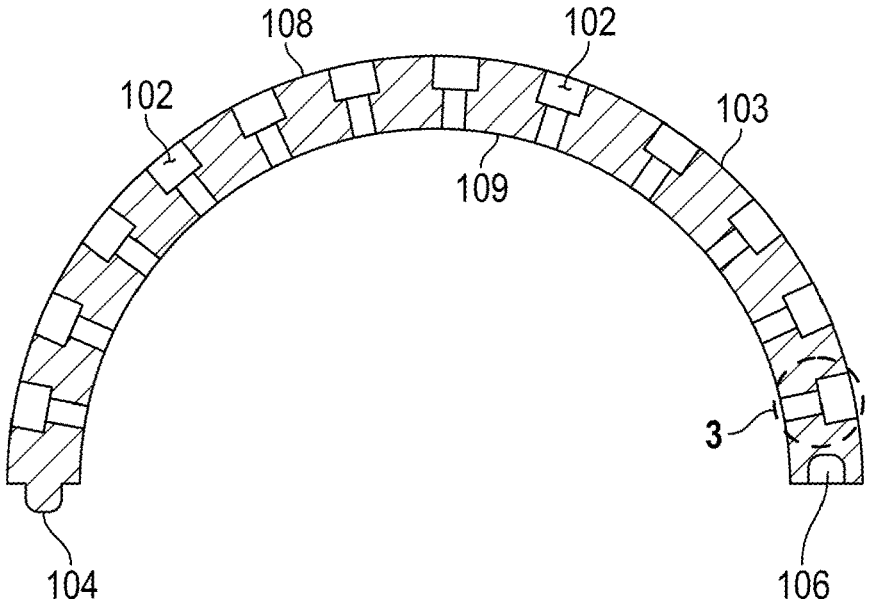
FIG. 2 shows a sectional view of one half of the wire bending jig of FIG. 1, taken along lines 2-2 of FIG. 1.

For example, piece 103, as shown FIG. 2, can have a tab 104 that fits into a corresponding slot 106 in piece 103A. Likewise, piece 103A can have a tab 104 that fits into a corresponding slot 106 in piece 103. With tabs 104 inserted into slot 106, a contiguous external surface having an outer perimeter 108 is formed. Additionally, a contiguous internal surface having an inner perimeter 109 is also formed. Pieces 103 and 103A can be releasably joined to each other or, alternatively, pieces 103 and 103A can be secured together, such as, for example, with glue. Alternatively, jig 100 can be formed from a single piece.

In an exemplary embodiment, jig 100 has a height of about 50 mm. Further, outer perimeter 108 has a diameter of about 70 mm and inner perimeter 109 has a diameter of about 60 mm, resulting in jig 100 having a thickness between outer perimeter 108 and inner perimeter 109 of about 5 mm. Jig 100 can be constructed from a rigid material, such as, for example, a rigid plastic, although those skilled in the art will recognize that jig 100 can be constructed from other rigid materials as well.

As shown FIG. 2, a plurality of through-openings 102 extend between outer perimeter 108 and inner perimeter 109. Through-openings 102 are spaced around jig 100 in a plurality of rows. Adjacent through-openings 102 can be spaced apart about 10 mm on center and adjacent rows can be spaced apart about 5 mm on center. In an exemplary embodiment, each row is radially offset from a vertically adjacent row about 5 mm on center, although those skilled in the art will recognize that through-openings 102 can be arranged around jig 100 in any desired order or pattern, such as, for example, a repeating pattern.

Each through opening 102 has a first, larger diameter D1 extending toward outer perimeter 108 and a second, smaller diameter D2 extending toward inner perimeter 109. A generally planar ledge 110 is formed at a junction between first diameter D1 and second diameter D2.

Figure 3:
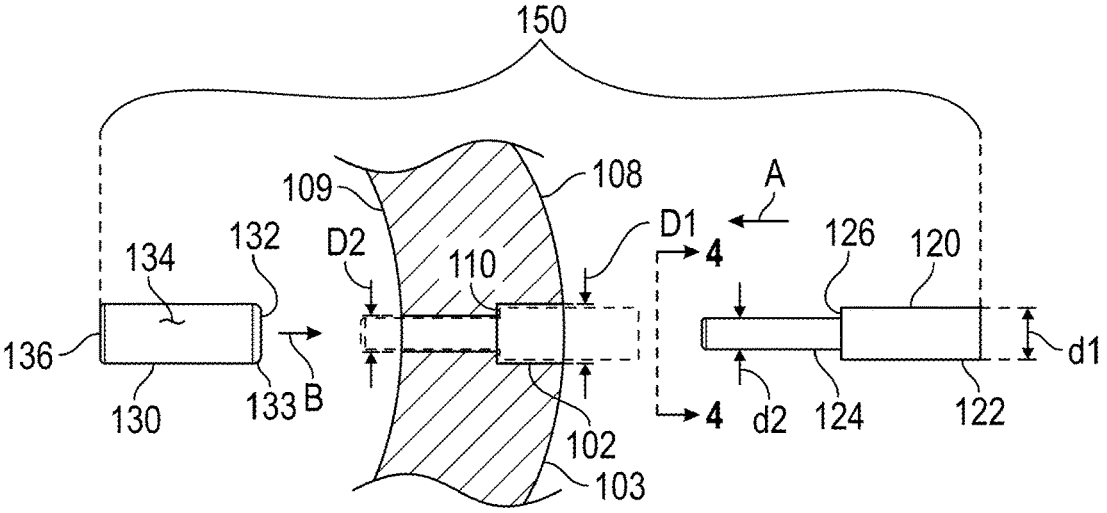
FIG. 3 is an enlarged view of a portion of the wire bending jig of FIG. 2, taken along circle 3 of FIG. 2, with a pin for use with the jig being shown inserted therein.

As shown FIG. 3, a pin 120 is sized to be removably insertable into through-opening 102 in the direction of arrow "A". While a plurality of pins 120 can be used with jig 100, the description of a single pin 120 below pertains to the plurality of pins 120.

Figure 4:
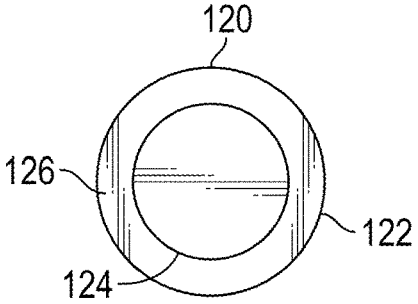
FIG. 4 is an end view of the pin shown in FIG. 3, taken along lines 4-4 of FIG. 3.

Pin 120 has a first portion 122 having a first diameter d1 and a second portion 124 having a second diameter d2, smaller than the first diameter d1. A ridge 126 is formed where first portion 122 and second portion 124 meet. In an exemplary embodiment, pin 120 can be constructed from a light-weight rigid material, such as, for example, aluminum or brass, although those skilled in the art will recognize that other suitable rigid materials can be used. Save As shown in FIG. 4, first portion 122 and second portion 124 of pin 120 are each generally cylindrical in cross-section, although those skilled in the art will recognize that pin 120 can have different shapes, such as, for example, triangular, square, or any other desired shape.

Pin 120 can be inserted into through-opening 102 from outer perimeter 108 toward inner perimeter 109 until ridge 126 engages ledge 110. First portion 122 extends outwardly from outer perimeter 108 and second portion 124 extends inwardly from inner perimeter 109 as shown in broken lines in FIG. 3.

To secure each pin 120 in its respective through-opening 102, a retaining element, such as, for example, a sleeve 130, can be releasably inserted over second portion 124 extending inwardly of inner perimeter 109 in the direction of arrow "B", shown in FIG. 3. Locking sleeve 130 can be constructed from a pliable material having at least one opening 132 at a first end 133 and a hollow interior 134 configured to releasably engage second portion 124. A second end 136 of sleeve 130 can optionally be open or closed. An exemplary pliable material for locking sleeve 130 can be a pliable plastic tubing, such as, for example, neoprene, although those skilled in the art will recognize that other suitable material can be used.

In an exemplary embodiment, interior 134 can have a diameter at least slightly smaller than second diameter d2 of pin 120, such that locking piece 130 can be inserted over second portion 124, with a slightly interference fit.

With pin 120 fully inserted into one of through-openings 102, opening 132 in sleeve 130 can be inserted over second portion 124 of pin 120 to releasably secure pin 120 within through-opening 102. This process can be repeated with additional pins 120 inserted into other through-openings 102, with each pin 120 being secured to its respective through-opening 102, with a sleeve 130.

When all desired pins 120 are inserted into jig 100, a user can take a strand of wire, not shown, and wrap the wire around first portion 122 of pins 120 in desired fashion to form the wire into a desired shape, such as, for example, a bracelet. To remove the bracelet from jig 100, sleeves 130 are removed from their respective pin 120, with pin 120 then being removed from jig by pulling pin 120 outwardly from outer perimeter 108 of jig 100. Jig 100 can then be slid from the bracelet.

In an exemplary embodiment, jig 100, a plurality of pins 120 and a plurality of sleeves 130 can be provided together as a kit 150, shown in FIG. 3.

Figure 5:
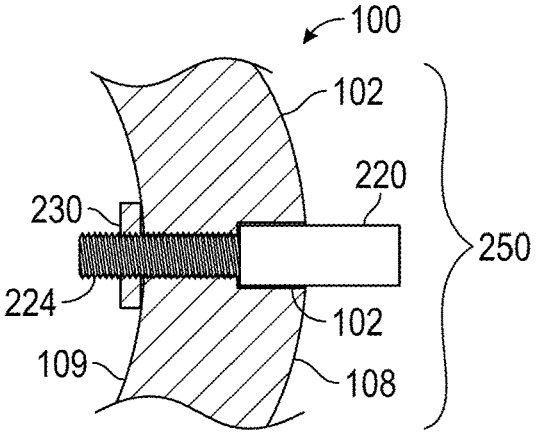
FIG. 5 is a top plan view of an alternative embodiment of a pin for use with the jig of FIG. 1.
Figure 6:
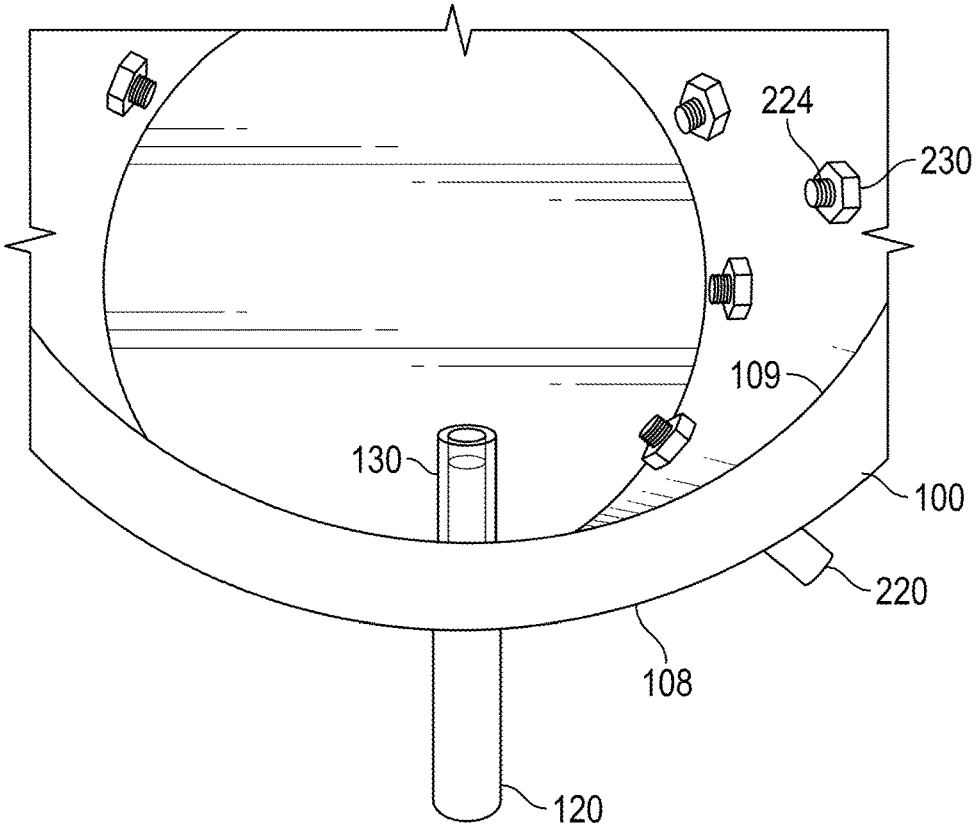
FIG. 6 is a perspective view of the jig of FIG. 1 being used with the pin of FIG. 4 and the pin of FIG. 5.

An alternative embodiment of a pin 220 that can be used with jig 100 is shown in FIG. 5. Pin 220 is similar to pin 120 except that second portion 224 of pin 220 can be threaded. A nut 230 can be threaded onto second portion of 224 to releasably secure pin 220 within through-opening 120. FIG. 6 shows jig 100 with pin 120 and sleeve 130 as well as pin 220 and nut 230.

Similar to kit 150, jig 100, the plurality of pins 220, and a plurality of nuts 230 can also be provided together as a kit 250, shown FIG. 5.

Figure 5A:
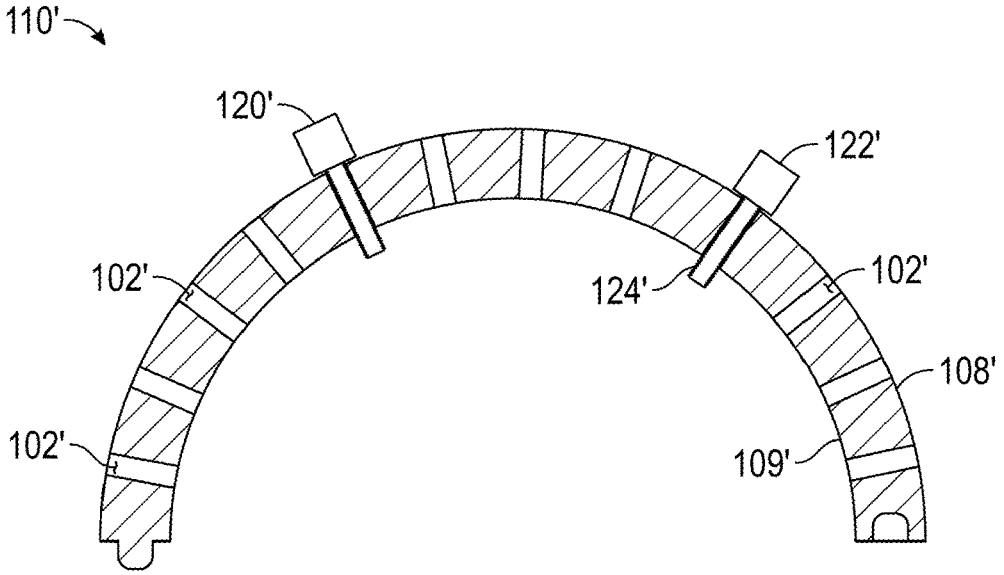
FIG. 5A shows a sectional view of an alternative exemplary embodiment of one half of a three-dimensional wire bending jig according to the present invention.

In an alternative embodiment of a jig 100', shown in FIG. 5A, the through-openings 102' have a constant diameter between outer perimeter 108' and inner perimeter 109'. Pins 120' have a first portion 122' having a diameter larger than the diameter of through-opening 102' and a second portion 124' having a diameter smaller than the diameter of through-opening 102' such that second portion 124' of pin 120' can be inserted into through-opening 102', with first portion 122' of pin 120' remaining outside of outer perimeter 108'.

Alternatively, although not shown, jig 100' can also be used with pins 220 and nut 230 disclosed above. Second portion 224 of pin 220 is sufficiently long to extend through through-opening 102' and still extend outwardly of inner perimeter 109' sufficiently enough to allow not 220 to be threaded onto second portion 224 of pin 220.

Figure 7:
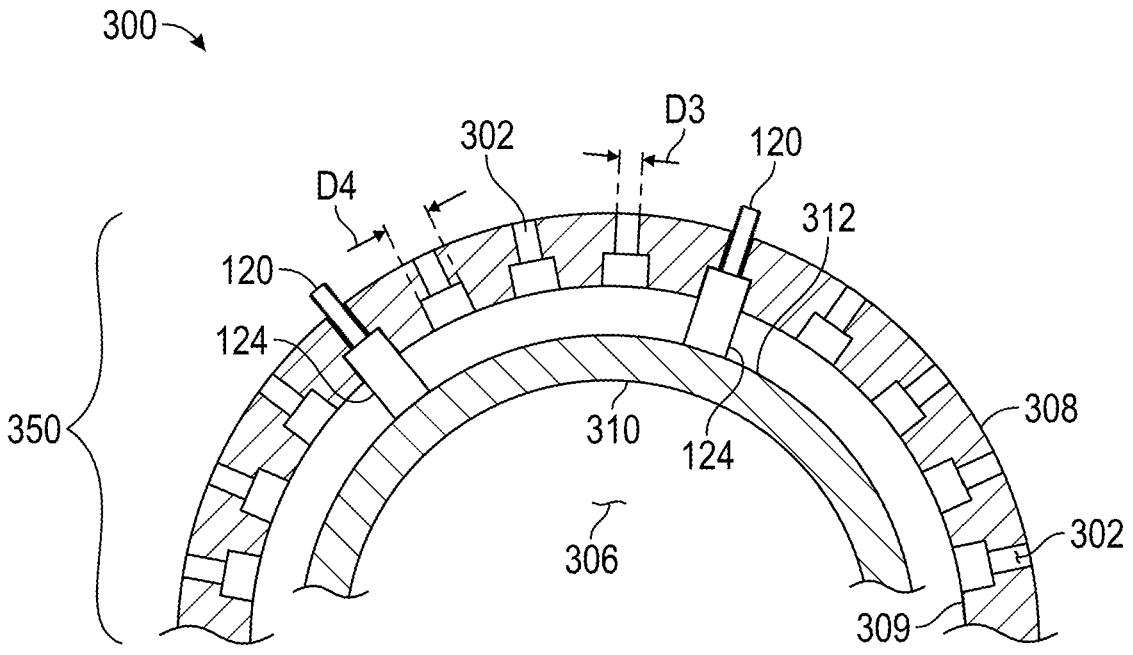
FIG. 7 is a top plan view of an alternative embodiment of a three-dimensional wire bending jig according to an alternative exemplary embodiment of the present invention.

An alternative embodiment of a three dimensional wire bending jig 300 ("jig 300") according to the present invention is shown FIG. 7. Jig 300 is similar to jig 100, with the exception that, instead of through-openings 102 having a larger diameter D1 located closer to outer perimeter 108 and a smaller diameter D2 located closer to inner perimeter 109, jig 300 has through-openings 302 having a smaller diameter D3 located closer to outer perimeter 308 and a larger diameter D4 located closer to inner perimeter 309.

Pins 120 used with jig 100 can also be used with jig 300 except that, instead of inserting pins 120 into jig 100 from outer perimeter 108, pins 120 are inserted into jig 300 from inner perimeter 309 to the position as shown in FIG. 7.

After all of the desired pins 120 are inserted into their respective through-openings 302, a generally cylindrical sleeve 310 can be slid into jig 300 within space 306 formed by inner perimeter 309 within jig 300. Sleeve 310 engages second portion 124 of pin 120 to retain pin 120 within through-opening 302.

Sleeve 310 can be sized with an outer diameter 312 sufficiently large to force pins 120 into their respective through-opening 302, such that sleeve 310 can be retained within jig 300 by a frictional fit, allowing jig 300 to be manipulated without sleeve 310 falling out of jig 300.

Alternatively, if second portion 124 of pin 120 is sufficiently small, and the entirety of second portion 124 of pin 120 can be retained within through-opening 302, sleeve 310 can be sized such that outer perimeter 312 of sleeve engages inner perimeter 309 of jig 300 with a frictional fit.

A bracelet can then be made using jig 300 in the same manner as described above with respect to jig 100. After the bracelet has been made, the bracelet can be removed from jig 300 by sliding sleeve 310 from jig 300 and pushing pins 120 from outer perimeter 308 inward toward inner perimeter 309 until pins no longer extends outwardly from outer perimeter 308. The bracelet can then be slid off of jig 300.

Jig 300, pins 120, and sleeve 310 can be provided together as a kit 350, as shown in FIG. 7.

Figure 7A:
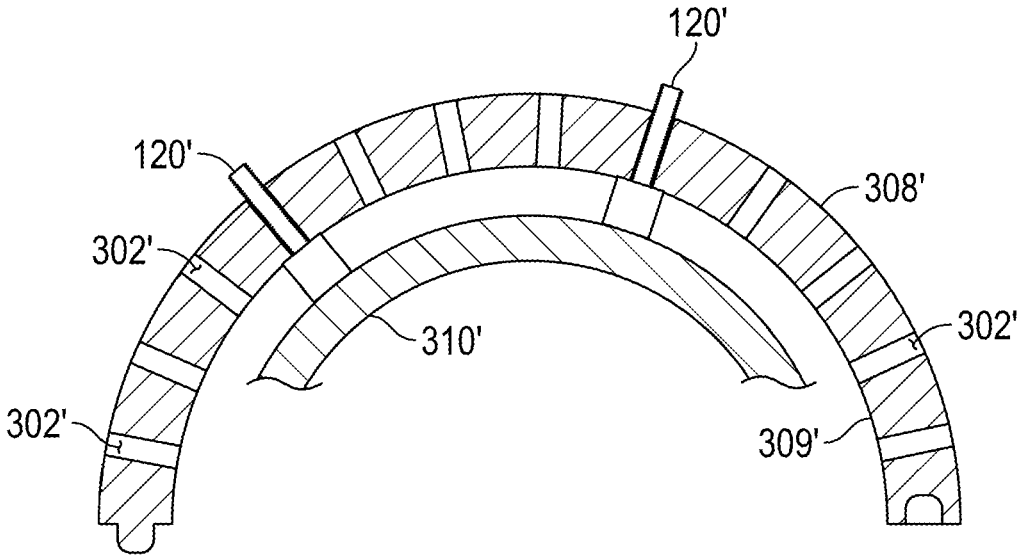
FIG. 7A shows a sectional view of another alternative exemplary embodiment of one half of a three-dimensional wire bending jig according to the present invention.

Similarly to jig 100', shown in FIG. 5A, as shown FIG. 7A, a jig 300' can have through-openings 302' having a constant diameter between outer perimeter 308' and inner perimeter 309'. Pins 120' can be inserted into through-openings 302' from inner perimeter 309' such that first portion 122' is larger than the diameter of through-opening 302' and engages the wall of inner perimeter 309', while second portion 124' extends through through-opening 302' and outwardly of outer perimeter 308'.

Similarly to cylindrical sleeve 310, which is shown in FIG. 7, a cylindrical sleeve 310' is sized to engage second portion 124' of pin 120' to retain pin 120' within through-opening 302'.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A kit comprising:

a three-dimensional wire bending jig comprising:

a tubular body having an outer surface and an inner surface, the body having a plurality of through-openings formed therein, wherein the plurality of through-openings form a repeating pattern around the body;

a pin releasably inserted into one of the plurality of through-openings, the pin having a head portion engaging the inner surface and a body portion, thinner than the head portion, wherein the body portion extends through the one of the plurality of through-openings and inwardly from the inner surface; and a sleeve extending over the body portion extending inwardly from the inner surface.

2. The kit according to claim 1, wherein each of the plurality of through-openings has a first diameter proximate to the outer surface and a second diameter proximate to the inner surface.

3. The kit according to claim 2, wherein the first diameter is the same size as the second diameter.

4. The kit according to claim 2, wherein the first diameter is smaller than the second diameter.

5. A kit comprising:

a three-dimensional wire bending jig comprising a tubular body having an outer surface and an inner surface having an inner diameter, the body having a plurality of through-openings formed therein, wherein the plurality of through-openings form a repeating pattern around the body;

a plurality of pins, at least one of the plurality of pins releasably inserted into one of the plurality of through-openings, each of the plurality of pins having a head and a body attached to the head, the body extending into the jig from the inner surface; and a cylindrical sleeve having an outer diameter smaller than the inner diameter of the body, such that the sleeve is disposed inside the jig and blocks the at least one of the plurality of pins such that the one of the plurality of pins cannot be removed from the one of the plurality of through-openings.

6. The kit according to claim 5, wherein the body of each of the plurality of pins is adapted to extend outwardly from the outer surface of the tubular body when each of the plurality of pins is inserted into one of the plurality of through-holes.

7. The kit according to claim 5, wherein each of the plurality of through-openings has a first diameter proximate to the outer surface and a second diameter proximate to the inner surface.

8. The kit according to claim 7, wherein the first diameter is the same size as the second diameter.

9. The kit according to claim 7, wherein the first diameter is smaller than the second diameter.

10. A kit comprising:

a three-dimensional wire bending jig comprising a tubular body having an outer surface and an inner surface, the body having a plurality of through-openings formed therein, wherein the plurality of through-openings form a repeating pattern around the body;

a pin releasably inserted into one of the plurality of through-openings such that a first portion extends outwardly from the outer surface and a second portion extends inwardly from the inner surface; and a tubular retaining element releasably slid over the second portion and retaining the pin in the one of the plurality of through-openings.

* * * * *